US010260457B2

(12) United States Patent
Abei et al.

(10) Patent No.: US 10,260,457 B2
(45) Date of Patent: Apr. 16, 2019

(54) IMPULSE PUMP

(71) Applicant: WALBRO LLC, Tucson, AZ (US)

(72) Inventors: Takashi Abei, Sendai (JP); Naoya Kumagai, Iwanuma (JP)

(73) Assignee: Walbro LLC, Tuscon, AZ (US)

( * ) Notice: Subject to any disclaimer, the term of this patent is extended or adjusted under 35 U.S.C. 154(b) by 63 days.

(21) Appl. No.: 15/520,540

(22) PCT Filed: Nov. 5, 2015

(86) PCT No.: PCT/US2015/059205

§ 371 (c)(1),
(2) Date: Apr. 20, 2017

(87) PCT Pub. No.: WO2016/073697

PCT Pub. Date: May 12, 2016

(65) Prior Publication Data

US 2017/0314510 A1 Nov. 2, 2017

Related U.S. Application Data

(60) Provisional application No. 62/075,938, filed on Nov. 6, 2014.

(51) Int. Cl.
*F02M 17/00* (2006.01)
*F02M 17/34* (2006.01)
(Continued)

(52) U.S. Cl.
CPC ..... *F02M 17/34* (2013.01); *F02M 7/08* (2013.01); *F02M 17/04* (2013.01);
(Continued)

(58) Field of Classification Search
CPC ..... F02M 17/04; F02M 17/34; B01F 3/04
(Continued)

(56) References Cited

U.S. PATENT DOCUMENTS 4,271,093 A 6/1981 Kobayashi
4,448,280 A 5/1984 Endo
(Continued)

FOREIGN PATENT DOCUMENTS

CN 101139957 A 3/2008
CN 101338709 A 1/2009
(Continued)

OTHER PUBLICATIONS

International Search Report and Written Opinion of the International Searching Authority in PCT/US2015/059205 dated Feb. 18, 2016 (9 pages).
(Continued)

*Primary Examiner* — Robert A Hopkins
(74) *Attorney, Agent, or Firm* — Reising Ethington P.C.

(57) ABSTRACT

In at least some implementations, a carburetor includes a body, a fuel pump diaphragm and a pressure pulse passage. The fuel pump diaphragm is carried by the body and defines in part a fuel chamber on one side of the fuel pump diaphragm and a pressure pulse chamber on the other side of the fuel pump diaphragm. The pressure pulse passage communicates the pressure pulse chamber with a pressure pulse source to provide pressure pulses in the pressure pulse chamber to actuate the fuel pump diaphragm. The pressure pulse passage includes an inlet communicating with a passage in which pressure pulses are present and the inlet is spaced from a surface defining the passage in which pressure pulses are present.

19 Claims, 3 Drawing Sheets

(51) Int. Cl.

| | |
|---|---|
| ***F02M 7/08*** | (2006.01) |
| ***F02M 17/04*** | (2006.01) |
| ***F02M 37/04*** | (2006.01) |
| ***F02M 37/12*** | (2006.01) |
| *F04B 43/06* | (2006.01) |

(52) U.S. Cl.
CPC ..... *F02M 37/046* (2013.01); *F02M 37/12* (2013.01); *F04B 43/06* (2013.01)

(58) Field of Classification Search
USPC ..... 261/38
See application file for complete search history.

(56) References Cited

U.S. PATENT DOCUMENTS

| | | | |
|---|---|---|---|
| 5,073,307 | A | 12/1991 | Langer et al. |
| 5,711,901 | A | 1/1998 | Berg et al. |
| 6,142,454 | A | 11/2000 | Aronsson et al. |
| 6,688,585 | B2 | 2/2004 | Braun et al. |
| 7,467,785 | B2 | 12/2008 | Braun |
| 7,770,559 | B2 | 8/2010 | Cobb |
| 8,394,165 | B2 | 3/2013 | Haussner et al. |
| 2001/0048167 | A1 | 12/2001 | Pattullo et al. |

FOREIGN PATENT DOCUMENTS

| | | | | | |
|---|---|---|---|---|---|
| JP | 2000265906 | A | | 9/2000 | |
| JP | 2001263174 | A | * | 9/2001 | ..... F02M 17/04 |
| JP | 2002-285911 | A | | 10/2002 | |
| JP | 2004028012 | A | | 1/2004 | |

OTHER PUBLICATIONS

CN Office Action for CN Application No. 201580060386.8 dated Dec. 6, 2018 (7 pages).

* cited by examiner

IMPULSE PUMP

REFERENCE TO CO-PENDING APPLICATIONS

This application claims the benefit of U.S. Provisional Patent Application Ser. No. 62/075,938 filed Nov. 6, 2014, which is incorporated herein by reference in its entirety.

TECHNICAL FIELD

The present disclosure relates generally to a carburetor.

BACKGROUND

Carburetors are used to provide the combustion fuel requirements for a wide range of two-cycle and four-cycle engines including hand held engines, such as engines for chainsaws and weed trimmers, as well as a wide range of marine engine applications. Diaphragm type carburetors are particularly useful for hand held engine applications wherein the engine may be operated in substantially any orientation, including upside-down. These carburetors utilize a fuel-metering diaphragm which is operative to control the delivery of fuel from the carburetor regardless of its orientation. Additionally, some carburetors utilize a diaphragm type fuel pump which is responsive to engine pressure pulses to draw fuel from a fuel supply and to deliver fuel to the fuel metering assembly under pressure. The fuel pump diaphragm defines a fuel chamber on one side which receives liquid fuel and a pressure pulse chamber on its other side in communication with the engine to receive pressure pulses which actuate the fuel pump diaphragm.

SUMMARY

In at least some implementations, a carburetor includes a body, a fuel pump diaphragm and a pressure pulse passage. The fuel pump diaphragm is carried by the body and defines in part a fuel chamber on one side of the fuel pump diaphragm and a pressure pulse chamber on the other side of the fuel pump diaphragm. The pressure pulse passage communicates the pressure pulse chamber with a pressure pulse source to provide pressure pulses in the pressure pulse chamber to actuate the fuel pump diaphragm. The pressure pulse passage includes an inlet communicating with a passage in which pressure pulses are present and the inlet is spaced from a surface defining the passage in which pressure pulses are present.

In at least one example, the passage in which pressure pulses are present includes a fuel and air mixing passage in the body and the inlet of the pressure pulse passage is spaced from a surface of the body that defines at least part of the fuel and air mixing passage. The pressure pulse passage may include or be defined in part by a pick-up carried by the carburetor body and extending into the fuel and air mixing passage. The pick-up may have an inlet end oriented below the point of connection between the pick-up and the body in the normal orientation of the carburetor and relative to the direction of gravitational force. The pressure pulse passage may be oriented to inhibit liquid fuel from entering the pressure pulse passage, such as by having the inlet of the pressure pulse passage face away from the direction of fluid flow in the region of the inlet. Examples may include orienting the pick-up relative to the carburetor body to inhibit liquid fuel from entering the pick-up, providing a pick-up with an upstream facing side that is longer than a downstream facing side, or providing a pick-up with an inlet that is closer to the outlet end of the mixing passage than is the portion of the pick-up connected to the carburetor body. In at least some implementations, a carburetor includes a body, a diaphragm and a pressure pulse passage. The diaphragm is carried by the body and defines in part a fuel chamber on one side of the fuel pump diaphragm and a pressure pulse chamber on the other side of the diaphragm. The pressure pulse passage communicates the pressure pulse chamber with a pressure pulse source to provide pressure pulses in the pressure pulse chamber to actuate the diaphragm. The pressure pulse passage includes an inlet communicating with a passage in which pressure pulses are present and the inlet being spaced from a surface defining the passage in which pressure pulses are present. In certain implementations, the diaphragm may be part of a fuel pump assembly or a fuel metering assembly. The pressure pulse passage may include or be defined in part by a pick-up that extends from the carburetor body into a fuel and air mixing passage of the carburetor body. And the pick-up may be oriented with an inlet end arranged in the fluid flow within the fuel and air mixing passage and spaced from a surface of the carburetor body. The pick-up may be oriented to inhibit the flow of liquid fuel into the pick-up or pressure pulse passage.

BRIEF DESCRIPTION OF THE DRAWINGS

The following detailed description of certain embodiments and best mode will be set forth with reference to the accompanying drawings, in which.

DETAILED DESCRIPTION

Figure 1:
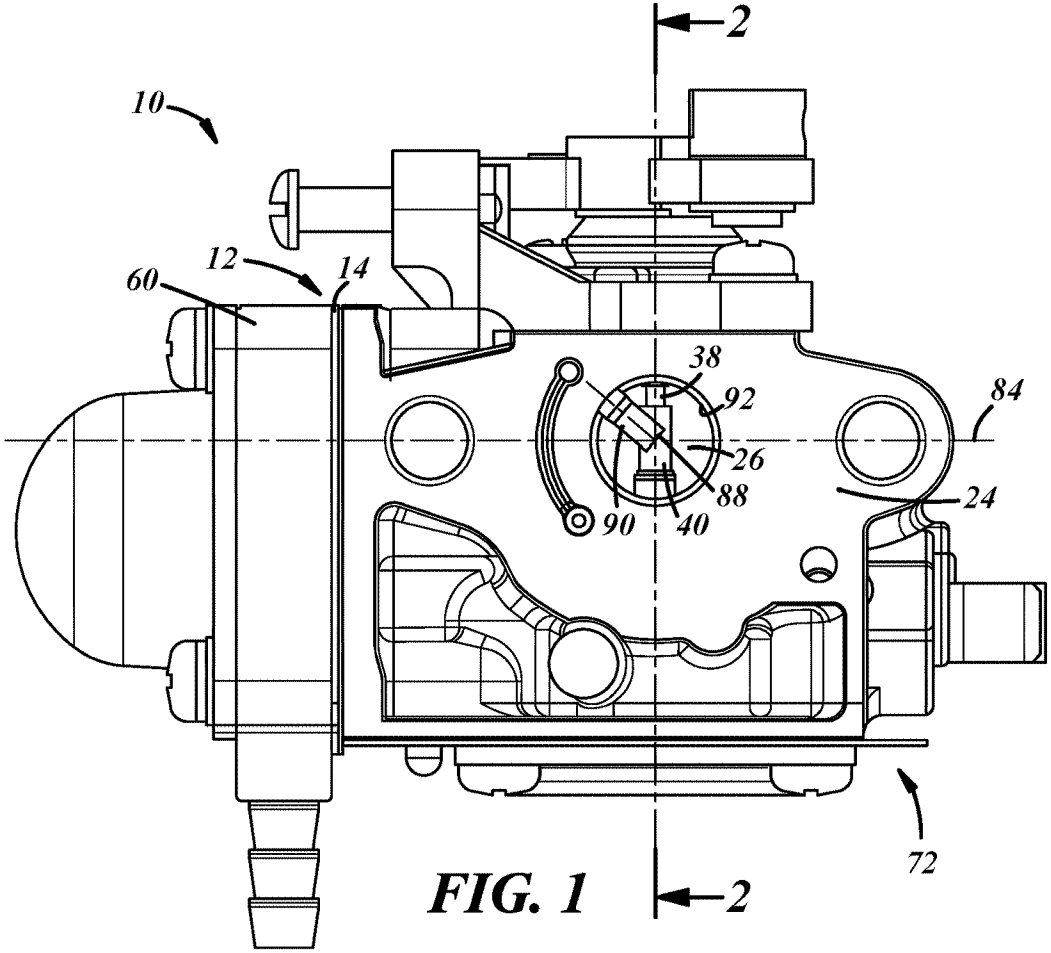
FIG. 1 is a front view of a carburetor showing a pulse pick-up extending into a fuel and air mixing passage of the carburetor.
Figure 2:
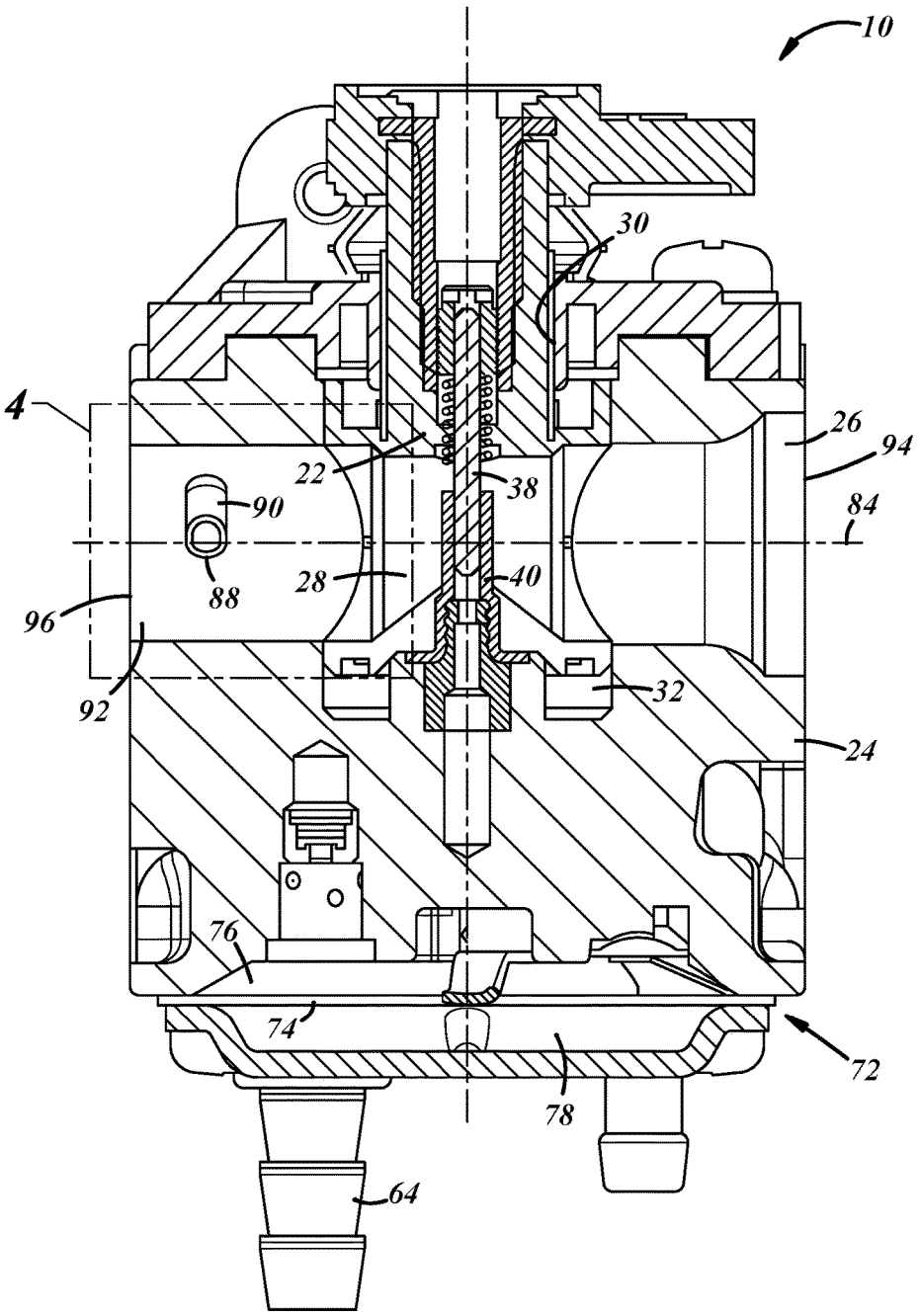
FIG. 2 is a cross-sectional view of the carburetor of FIG. 1 showing the pulse pick-up.
Figure 3:
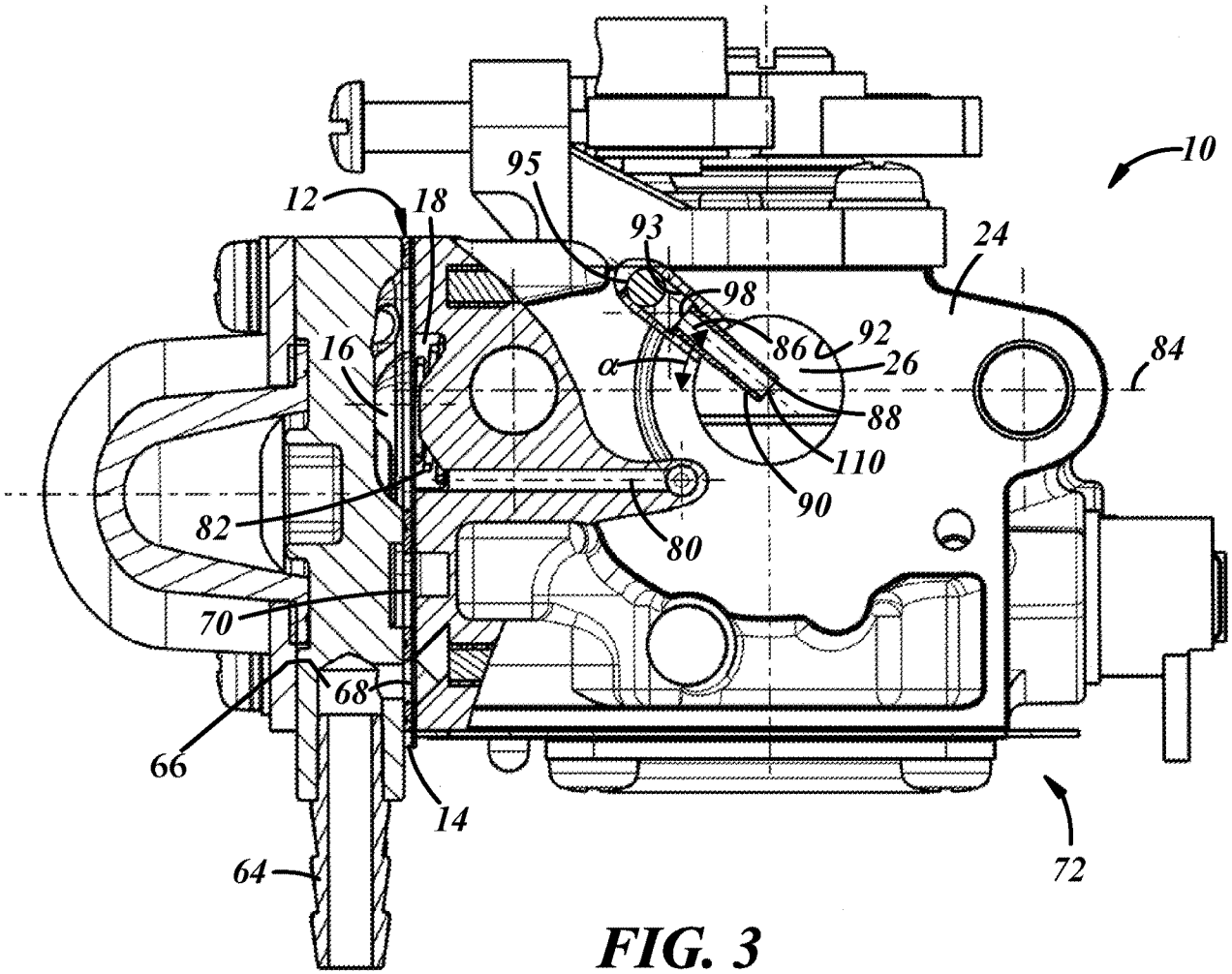
FIG. 3 is a front view, partially in section, of the carburetor of FIG. 1 showing a fuel pump assembly of the carburetor.

Referring in more detail to the drawings, FIGS. 1-3 illustrate a rotary throttle valve type carburetor 10. As shown in FIG. 3, the carburetor 10 has a fuel pump 12 with a diaphragm 14 defining in part a fuel chamber 16 on one side and a pressure pulse chamber 18 on its other side. To actuate the fuel pump 12, pressure pulses are communicated with the pulse chamber 18 through one or more passages or conduits. The passages and/or conduits may be defined internally within the carburetor main body 24, or by one or more tubes or hoses that extend, at least partially, outside of the main carburetor body 24.

As shown in FIG. 2, the carburetor main body 24 has a fuel and air mixing passage 26 formed therethrough and a rotary throttle valve 22 is disposed in the fuel and air mixing passage 26. The throttle valve 22 has a through bore 28 selectively and progressively aligned with the fuel and air mixing passage 26 as the throttle valve 22 is moved between idle and wide open positions to control the flow of air and fuel through the carburetor 10. The throttle valve 22 has a generally cylindrical shaft rotatably received in a complementary bore 30 in the body 24 extending generally transversely to the fuel and air mixing passage 26. A cam or other mechanism may displace the throttle valve 22 axially as the throttle valve is rotated between its idle and wide open positions. This axial movement of the throttle valve 22 moves a needle 38 carried by the throttle valve 22 relative to a fuel jet 40 carried by the carburetor body 24 to vary the size of an orifice of the fuel jet 40 to thereby control, at least in part, the amount or rate of fuel discharged from the orifice.

Fuel is provided to the fuel jet 40 by the fuel pump 12 and a fuel metering assembly 72. The fuel pump 12 may include the fuel pump diaphragm 14 trapped between an end plate 60 and the carburetor body 24 with a gasket optionally received between the diaphragm 14 and main carburetor body 24. A fuel inlet fitting 64 is carried by the end plate 60 and communicates with the fuel chamber 16 through an internal passage 66 of the carburetor body 24 with a flap type inlet valve 68, preferably integral with the fuel pump diaphragm 14, preventing the reverse flow of fuel out of the fuel chamber 16. Fuel that flows through the inlet valve 68 enters the fuel chamber 16 defined in part by the fuel pump diaphragm 14. Fuel discharged from the fuel chamber 16 flows through an outlet valve 70 which is also preferably a flap type valve integral with a fuel pump diaphragm 14.

From there, fuel flows to the fuel metering assembly 72 having, as shown in FIG. 2, a fuel metering diaphragm 74, fuel metering chamber 76, a reference chamber 78 and a diaphragm controlled inlet valve (not shown) which selectively permits fuel flow into the fuel metering chamber 74. From the fuel metering chamber 76, the fuel flows to the fuel jet 40 and into the fuel and air mixing passage 26 in response to a differential pressure across the fuel jet 40, in a known manner. The fuel metering assembly 72 may be as disclosed in U.S. Pat. No. 5,711,901 the disclosure of which is incorporated herein by reference in its entirety.

Returning to FIG. 3, the pressure pulse chamber 18 is defined on the other side of the fuel pump diaphragm 14 from the fuel chamber 16 and communicates with the engine intake manifold through a pressure pulse passage 80 that opens into the fuel and air mixing passage 26. Engine pressure pulses from the intake manifold are thus communicated with the pressure pulse chamber 18 to vary the pressure therein. Notably, with four-stroke engines, the pressure pulse is predominantly negative or a vacuum pressure which tends to displace the fuel pump diaphragm 14 in a direction tending to increase the volume of the fuel chamber 16 to draw fuel therein. A spring 82, provides a biasing or return force which tends to displace the fuel pump diaphragm 14 in a direction tending to decrease the volume of the fuel chamber 16 to discharge fuel from the fuel chamber 16 under pressure. In this manner, the displacement of the fuel pump diaphragm 14 draws fuel into the carburetor 10 and discharges fuel under pressure to the fuel metering assembly 72 it is made available to the engine corresponding to the engine's fuel demand.

In at least some implementations, the pulse passage 80 communicates at one end with the fuel and air mixing passage 26 and at its other end with the pressure pulse chamber 18. The passage 80 may be routed externally of the carburetor 10, for instance, through an external conduit leading from a location downstream of an air filter and extending directly into the pressure pulse chamber 18. Alternatively, the passage 80 can be routed entirely internally within the carburetor body 24 or partially internally and partially externally, as desired.

In at least some implementations, the pulse passage 80 opens into the fuel and air mixing passage above (relative to the direction of gravitational force) a centerline 84 or plane through the mixing passage 26, when the carburetor 10 is in its normal orientation as shown in FIGS. 1 and 2. This orientation may represent a normal or common attitude of the carburetor 10 when installed on the device with which the carburetor is used. For example, an orientation of the carburetor 10 when used on a chainsaw and the chainsaw is being started, or is cutting something at ground level and the saw is cutting generally parallel to the direction of gravitational force. This may reduce the likelihood that fuel will enter the pulse passage 80 and interfere with operation of the fuel pump. Further, the pulse passage 80 may extend upwardly from the intersection or junction of the pulse passage 80 with the fuel and air mixing passage 26 before turning downwardly toward the fuel pump. This upward orientation of an inlet portion 86 of the pulse passage 80 may further inhibit liquid fuel from traveling in the pulse passage.

The pulse passage 80 may communicate with the fuel and air mixing passage 26 downstream of any venturi or reduced diameter portion of the mixing passage. In at least some versions, an inlet 88 of the pulse passage 80 is located downstream of the throttle valve 22 and closer to side of the carburetor 10 that is closer to the engine with which the carburetor is used. This may provide a better or stronger pulse signal to the fuel pump 12 through the pulse passage 80.

The pulse passage 80 may further include or be defined at least in part by a pick-up 90 or conduit that extends into the fuel and air mixing passage 26, rather than simply having the inlet 88 formed as a port in the surface 92 of the fuel and air mixing passage 26. The pick-up 90 may be tubular and generally cylindrical with a circular internal passage, or in any other desired form capable of communicating the pressure in the adjacent area of the fuel and air mixing passage 26 with the remainder of the pulse passage 80. The pick-up 90 may be made of any suitable material and in at least some implementations may be formed of metal, and may be formed separately from the carburetor body 24 and then coupled thereto. The pick-up 90 may be carried by or secured to the carburetor body 24 in any suitable way including by interference or press-fit, adhesive, threads or weld. In the non-limiting example shown, the pick-up 90 is threaded into a bore 93 that intersects the pulse passage 80 and the fuel and air mixing passage 26. The bore 93 may be closed by a plug 95.

The pick-up 90 may be received at least partially within the mixing passage 26, between the inlet 94 and outlet 96 sides of the mixing passage 26 (see FIG. 2), or outside of the mixing passage, downstream of the mixing passage and coupled to the pulse passage 80 or pump chamber 18 by an external conduit. In at least some implementations, such as is shown in FIGS. 1 and 2, the pick-up 90 is located downstream of the throttle valve 22. And while shown in a carburetor 10 having a rotary throttle valve 22, the pick-up 90 (or a pulse passage 80 having an inlet spaced from a surface of the mixing passage) may be used in other types of carburetors including, but not limited to, carburetors having a butterfly-style throttle valve.

In at least some implementations, the inlet pick-up 90 may be oriented upwardly, relative to gravity (e.g. the direction of gravitational force) and the normal orientation of the carburetor 10 in use. This positions the inlet 88 of the pick-up 90 lower than the opposite end 98 of the pick-up that is connected to the carburetor body 24. And this orients the inlet 88 of the pick-up 90 so that it faces downwardly, toward a lower portion of the mixing passage 26 (e.g. the portion on the opposite side of the centerline/axis 84 from the intersection of the pulse passage 80 with the fuel and air mixing passage 26). This orientation may further prevent liquid fuel from traveling into the pulse passage 80, at least in or near the normal orientation of the carburetor 10. In at least some implementations, the pick-up 90 may be oriented at an angle α (FIG. 3) of between 10 and 90 degrees relative to the axis 84 of the mixing passage 26.

Figure 4:
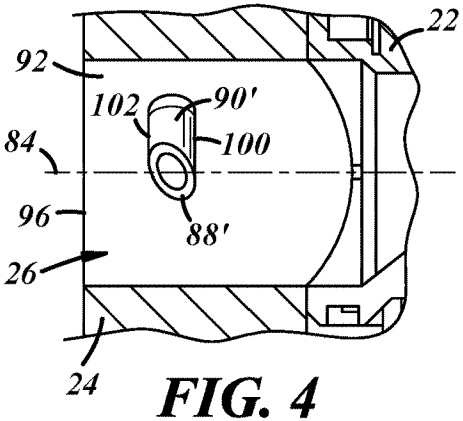
FIG. 4 is a schematic view of a fuel and air mixing passage and an alternate pick-up.
Figure 5:
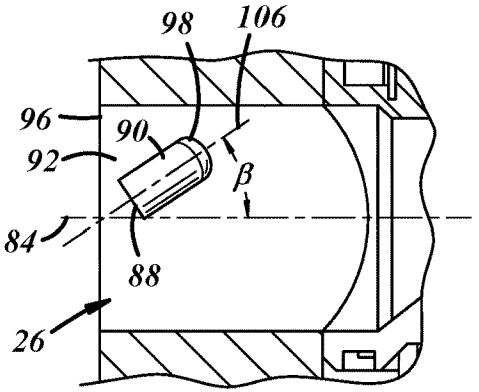
FIG. 5 is a schematic view of a fuel and air mixing passage and pick-up.

Further, as shown in FIG. 4, the upstream side 100 of an alternate pick-up 90' (i.e. the side farthest from the outlet end 96 of the fuel and air mixing passage 26) may extend further inwardly into the mixing passage than the downstream side 102 (i.e. the upstream facing side 100 of the pick-up 90 may be longer than the downstream side 102), to further inhibit fluid flow into the pick-up while still communicating the pressure at the inlet 88' with the remainder of the pulse passage 80. This may orient that inlet 88' of the pick-up 90 such that a plane parallel to the inlet is not parallel to the axis 84 of the mixing passage 26. A similar effect may also be obtained, instead of or in addition to the above and as shown in FIG. 5, by angling the pick-up 90 such that an axis 106 of the pick-up 90 is not perpendicular to the axis 84 of the mixing passage 26, and so that the inlet 88 faces generally away from the direction of fluid flow through the mixing passage 26. In other words, by orienting the pick-up 90 so that the inlet 88 is closer to the outlet end 96 of the mixing passage 26 than is the other end 98 of the pick-up 90. An angle β between the pick-up axis 106 and the axis of the mixing passage 84 may be between 0 and 90 degrees, and in at least some implementations is between 20 and 75 degrees.

Use of the pick-up 90 also moves the inlet 88 of the pulse passage 80 away from the surface 92 of the carburetor body 24 that defines the fuel and air mixing passage 26 and into the main fluid flow within or near the center of the fuel and air mixing passage 26. Fluid flow spaced from the mixing passage surface 92 is generally faster than fluid flow at the surface 92 and hence, is at a lower relative pressure. Thus, the pressure signal provided from a location spaced from the mixing passage surface 92 is of a greater magnitude which may facilitate driving the fuel pump diaphragm 14 and make the fuel pump 12 more responsive. In at least some implementations, the inlet 80 of the pick-up (and hence, the pulse passage 80) is generally aligned with the axis 84 of the fuel and air mixing passage 26, as shown in FIGS. 1-3. This may help to isolate the inlet 88 from the boundary layer of fluid flow or other affects on fluid flow caused by or at the surface 92 of the mixing passage 26.

Also, the pick-up, and pressure pulse passage generally, may be oriented to inhibit liquid fuel from entering the pressure pulse passage. This may be done in any number of ways, such as by angling the pick-up downwardly (e.g. relative to gravity and a normal orientation of the carburetor), but routing a portion of the pulse passage so that it extends from a lower portion to a higher portion, and/or by angling an inlet of the pressure pulse passage so that the inlet faces away from the direction of fluid flow in the region of the inlet. This may be done by providing the inlet at an angle that shields the inlet from fluid flow in the mixing passage (e.g. as shown in FIG. 4) or by orienting the entire pick-up at an angle, such as is shown in FIG. 5. Of course, other arrangements may be used as desired and the examples shown and described are not intended to represent all of the possibilities.

In at least some implementations, the pick-up inlet 88 may be at least 1 mm from the mixing passage surface 92. While in at least some embodiments aligning the inlet 88 with the center/axis 84 of the mixing passage 26, the inlet 88 may be spaced from the center line, such as by a pick-up 90 that is shorter or longer than the radius of the mixing passage 26. Further, while described in more detail with regard to the fuel pump diaphragm 14, the pulse passage arrangements may also be used with the fuel metering diaphragm 74 to communicate pressure pulses with the reference chamber 78 (which may then be called a pressure pulse chamber), if desired.

While the forms of the invention herein disclosed constitute presently preferred embodiments, many others are possible. For example, while the pick-up is shown as being a straight tubular component, it could be bent, twisted, curved, of varying diameter, or covered at least partially by a shield or screen, among other possibilities. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor, comprising:

a body;

a fuel pump diaphragm carried by the body and defining in part a fuel chamber on one side of the fuel pump diaphragm and a pressure pulse chamber on the other side of the fuel pump diaphragm; and a pressure pulse passage communicating the pressure pulse chamber with a pressure pulse source to provide pressure pulses in the pressure pulse chamber to actuate the fuel pump diaphragm, the pressure pulse passage including an inlet communicating with a passage having a centerline and in which pressure pulses are present and the inlet being spaced from a surface defining the passage in which pressure pulses are present and the inlet being closer to the centerline than is an adjacent portion of the surface defining the passage in which the pressure pulses are present.

2. The carburetor of claim 1 wherein the passage in which pressure pulses are present includes a fuel and air mixing passage in the body and wherein the inlet is spaced from a surface of the body that defines at least part of the fuel and air mixing passage.

3. The carburetor of claim 2 wherein the pressure pulse passage includes a pick-up carried by the carburetor body and projecting into the fuel and air mixing passage so that the inlet of the pick-up is closer to the centerline of the fuel and air mixing passage than is at least a portion of the surface that defines the fuel and air mixing passage.

4. The carburetor of claim 3 wherein the pick-up has an inlet end oriented below the point of connection between the pick-up and the body in the normal orientation of the carburetor and relative to the direction of gravitational force.

5. The carburetor of claim 1 wherein the pressure pulse passage is oriented to inhibit liquid fuel from entering the pressure pulse passage.

6. The carburetor of claim 5 wherein the inlet of the pressure pulse passage faces away from the direction of fluid flow in the region of the inlet.

7. The carburetor of claim 3 wherein the pick-up is oriented relative to the carburetor body to inhibit liquid fuel from entering the pick-up.

8. The carburetor of claim 7 wherein the pick-up has an upstream facing side that is longer than a downstream facing side.

9. The carburetor of claim 2 wherein the fuel and air mixing passage directs fluid flow from an inlet end to an outlet end, the pick-up has a portion connected to the carburetor body and an inlet arranged in the fuel and air mixing passage, and the inlet is closer to the outlet end of the mixing passage than is the portion of the pick-up connected to the carburetor body.

10. The carburetor of claim 1 wherein the inlet of the pressure pulse passage is at least 1 mm closer to the centerline than is an adjacent portion of the surface defining the passage in which the pressure pulses are present.

11. A carburetor, comprising:

a body;

a diaphragm carried by the body and defining in part a fuel chamber on one side of the diaphragm and a pressure pulse chamber on the other side of the diaphragm; and a pressure pulse passage communicating the pressure pulse chamber with a pressure pulse source to provide pressure pulses in the pressure pulse chamber to actuate the diaphragm, the pressure pulse passage including an inlet communicating with a passage having a centerline and in which pressure pulses are present and the inlet being spaced from a surface defining the passage in which pressure pulses are present and the inlet being closer to the centerline than is a portion of the surface defining the passage in which the pressure pulses are present, where said portion of the surface is adjacent to the inlet.

12. The carburetor of claim 11, wherein the diaphragm is part of a fuel pump assembly.

13. The carburetor of claim 11 wherein the diaphragm is part of a fuel metering assembly.

14. The carburetor of claim 11 wherein the pressure pulse passage includes a tubular pick-up carried by the carburetor body and extending into the fuel and air mixing passage to define an inlet of the pressure pulse passage.

15. The carburetor of claim 14 wherein the pick-up has an inlet end oriented below the point of connection between the pick-up and the body in the normal orientation of the carburetor and relative to the direction of gravitational force.

16. The carburetor of claim 14 wherein the pick-up is oriented to inhibit liquid fuel from entering the pickup.

17. The carburetor of claim 16 wherein the pick-up has an upstream facing side that is longer than a downstream facing side.

18. The carburetor of claim 16 wherein the carburetor body includes a fuel and air mixing passage through which fluid flows from an inlet end to an outlet end, the pick-up has a portion connected to the carburetor body and an inlet arranged in the fuel and air mixing passage, and the inlet is closer to the outlet end of the mixing passage than is the portion of the pick-up connected to the carburetor body.

19. The carburetor of claim 11 wherein the inlet of the pressure pulse passage is at least 1 mm closer to the centerline than is an adjacent portion of the surface defining the passage in which the pressure pulses are present.

* * * * *